US009624032B1

(12) United States Patent
Wilson

(10) Patent No.: US 9,624,032 B1
(45) Date of Patent: Apr. 18, 2017

(54) WASTE RECEPTACLE WITH INTEGRAL MANUAL WASTE COMPRESSOR AND ASSOCIATED METHOD

(71) Applicant: Gwendolyn M. Wilson, Fullerton, CA (US)

(72) Inventor: Gwendolyn M. Wilson, Fullerton, CA (US)

( * ) Notice: Subject to any disclaimer, the term of this patent is extended or adjusted under 35 U.S.C. 154(b) by 0 days.

(21) Appl. No.: 14/984,015

(22) Filed: Dec. 30, 2015

(51) Int. Cl.

| | |
|---|---|
| ***B30B 1/04*** | (2006.01) |
| ***B30B 15/06*** | (2006.01) |
| ***B65F 1/14*** | (2006.01) |
| ***B65F 1/02*** | (2006.01) |
| ***B65F 1/16*** | (2006.01) |
| ***B30B 9/30*** | (2006.01) |

(52) U.S. Cl.
CPC ..... *B65F 1/1405* (2013.01); *B30B 1/04* (2013.01); *B30B 9/3042* (2013.01); *B30B 9/3046* (2013.01); *B30B 9/3053* (2013.01); *B65F 1/02* (2013.01); *B65F 1/16* (2013.01); *B65F 2210/162* (2013.01)

(58) Field of Classification Search
CPC ..... B30B 9/306; B30B 9/323; B30B 9/3042; B30B 9/3053; B30B 9/3046; B30B 1/04; B65F 1/1405; B65F 1/02; B65F 1/16; B65F 2210/162; Y10S 220/908
USPC ... 100/226, 229 A, 227, 228, 230, 265, 266; 220/908
See application file for complete search history.

(56) References Cited

U.S. PATENT DOCUMENTS

| | | | | | |
|---|---|---|---|---|---|
| 2,137,191 | A * | 11/1938 | Legg | B02C 19/0087 | 100/265 |
| 2,433,815 | A * | 12/1947 | LaForge | A47J 19/022 | 100/243 |
| 2,465,839 | A * | 3/1949 | Bloomfield | B65F 1/1405 | 100/226 |
| 3,654,855 | A * | 4/1972 | Longo | B30B 9/305 | 100/229 A |
| 3,731,616 | A * | 5/1973 | Ligh | B30B 15/068 | 100/126 |
| 3,731,618 | A * | 5/1973 | Leman | B30B 9/3067 | 100/229 A |
| 4,050,373 | A * | 9/1977 | Hellmann | B30B 9/30 | 100/229 A |
| 4,269,114 | A * | 5/1981 | Schwarz | B30B 1/003 | 100/229 A |
| 5,042,374 | A * | 8/1991 | Klepacki | B30B 1/04 | 100/229 A |
| 5,419,250 | A * | 5/1995 | Ferguson | A47J 19/005 | 100/125 |

* cited by examiner

*Primary Examiner* — Jimmy T Nguyen

(57) ABSTRACT

A compressible trash receptacle includes a frame, a plunger section operably coupled to the frame wherein the plunger section is disposed partially exterior of the frame, and a trash-receiving section detachably connected to the frame and in communication with the plunger section. In this manner, when no external force acts on the plunger section, the plunger section rests at an equilibrium position disposed partially exterior of the trash-receiving section. Advantageously, when an external force acts on the plunger section, the plunger section moves to a tensioned position disposed partially interior of the trash-receiving section.

16 Claims, 10 Drawing Sheets

WASTE RECEPTACLE WITH INTEGRAL MANUAL WASTE COMPRESSOR AND ASSOCIATED METHOD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF NON-LIMITING EXEMPLARY EMBODIMENT(S) OF THE PRESENT DISCLOSURE

Technical Field

Exemplary embodiment(s) of the present disclosure relate to trash receptacles and, more particularly, to a compressible trash receptacle including a reservoir and a manually operated plunger that compacts trash stored inside the reservoir.

Prior Art

The accumulation of trash where the trash is generally light in weight because of containing drinking cups and molded food containers requires use of many plastic trash bags and considerable labor in handling the bags to maintain the trash receptacles at a level for receiving further trash. Further, considerable storage area is necessary in order to store the trash until it is removed by a disposal service.

The usual trash receptacles are initially lined with a plastic trash bag to receive the trash, and once the bag is full, it is necessary to close and tie off the bag and replace it with another empty bag. It is also necessary to take the bag full of trash to a disposal service area for storage until the disposal service removes the trash. The rapid build-up of trash requires manual handling of the trash bags on a frequent basis and thereafter the storage of those filled trash bags. A large enough storage area must be provided so as to accommodate storage of the trash bags prior to removal by a disposal service.

Accordingly, a need remains for a compressible trash receptacle in order to overcome at least one aforementioned shortcoming. The exemplary embodiment(s) satisfy such a need by providing a compressible trash receptacle including a reservoir and a manually operated plunger that is convenient and easy to use, lightweight yet durable in design, versatile in its applications, and designed for compacting trash stored inside the reservoir.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a compressible trash receptacle for selectively compacting trash stored therein. These and other objects, features, and advantages of the non-limiting exemplary embodiment(s) are provided by a compressible trash receptacle including a frame, a plunger section operably coupled to the frame wherein the plunger section is disposed partially exterior of the frame, and a trash-receiving section detachably connected to the frame and in communication with the plunger section. In this manner, when no external force acts on the plunger section, the plunger section rests at an equilibrium position disposed partially exterior of the trash-receiving section. Advantageously, when an external force acts on the plunger section, the plunger section moves to a tensioned position disposed partially interior of the trash-receiving section.

In a non-limiting exemplary embodiment, the frame includes a base having a first hinge portion, and a body extending upwardly from the base and configured to form an interstitial space thereabove. Such a body includes a bottom edge attached to the base, a plurality of arcuate grooves located above the bottom edge, a top edge, and a plurality of brackets affixed to the top edge and located above the arcuate grooves respectively. The frame further includes a lid having a central aperture formed therein, wherein the lid is positioned on the top edge and secured to the brackets.

In a non-limiting exemplary embodiment, the plunger section includes a handle, a shaft attached to the handle and having an axial bore extending along a longitudinal length thereof, a spring member dynamically located within the shaft, a stop member statically nested at a distal end of the shaft and engaged with the spring member, and a plate secured to the distal end of the shaft and located subjacent to the lid. Advantageously, the shaft and the plate synchronously reciprocate along a linear travel path aligned with the central aperture. Notably, the spring member is compressed to a tensioned state when the shaft and the plate downwardly ingress the trash-receiving section. Such a spring member is extended to a non-tensioned state when the shaft and the plate upwardly egress the trash-receiving section.

In a non-limiting exemplary embodiment, the plate is prohibited from egressing the frame while the plunger section is at both the equilibrium position and the tensioned position.

In a non-limiting exemplary embodiment, the spring member is prevented from being displaced below the stop member such that the spring member is compressed when the shaft is slidably displaced below the stop member.

In a non-limiting exemplary embodiment, the linear displacement of the shaft to the equilibrium position causes decompression of the spring member to the non-tensioned state so that the plate is elevated above the trash-receiving section.

In a non-limiting exemplary embodiment, the shaft is bifurcated into a first half and a second half. Such a shaft has a slot formed between the first half and the second half such that the stop member is slidably guided along the slot when the plunger section is lowered and raised between the tensioned position and the equilibrium position, respectively.

In a non-limiting exemplary embodiment, the trash-receiving section is located within the interstitial space and includes an access panel and a plurality of sidewalls coupled thereto, and a second hinge portion formed at the access panel. Such a second hinge portion is rotatably and detachably engaged with the first hinge portion such that the access panel is pivotal about a fulcrum axis oriented orthogonal to a centrally registered longitudinal axis of the frame. The trash-receiving section further includes a plurality of resilient fingers protruding outwardly from the sidewalls, respectively. Such resilient fingers are slidably engaged with the arcuate grooves, respectively, such that the access panel is guided along an arcuate path when biased between an open position and a closed position.

In a non-limiting exemplary embodiment, the resilient fingers are disengaged from the arcuate grooves such that the first hinge portion is detached from the second hinge portion.

The present disclosure further includes a method of utilizing a compressible trash receptacle for selectively compacting trash stored therein. Such a method includes the steps of: providing a frame; providing and operably coupling a plunger section to the frame so that the plunger section is disposed partially exterior of the frame; providing and detachably connecting a trash-receiving section to the frame; and communicating the trash-receiving section with the plunger section.

The method further includes the steps of: exerting no external force on the plunger section such that the plunger section rests at an equilibrium position disposed partially exterior of the trash-receiving section; and exerting an external force on the plunger section such that the plunger section moves to a tensioned position disposed partially interior of the trash-receiving section.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
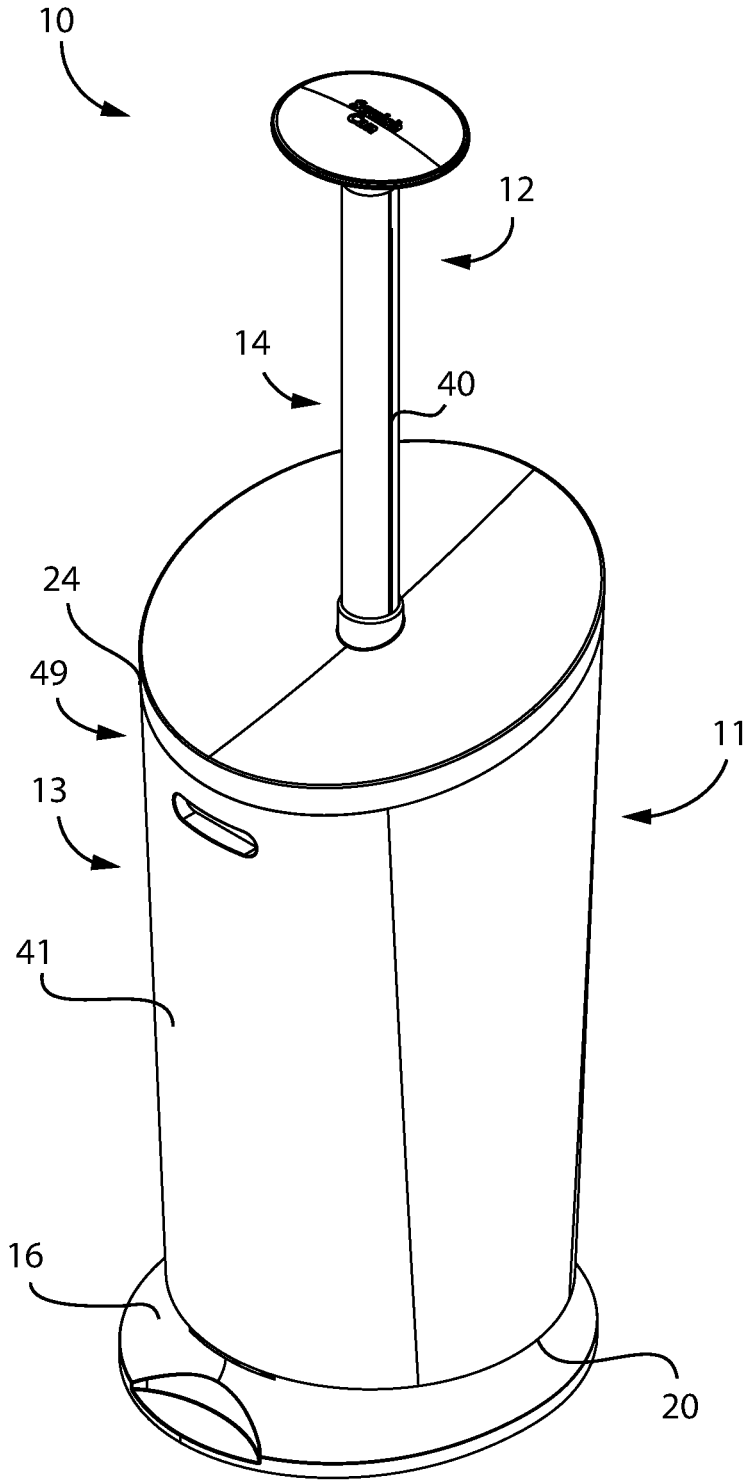
FIG. 1 is a perspective view of a compressible trash receptacle, in accordance with a non-limiting exemplary embodiment.
Figure 2:
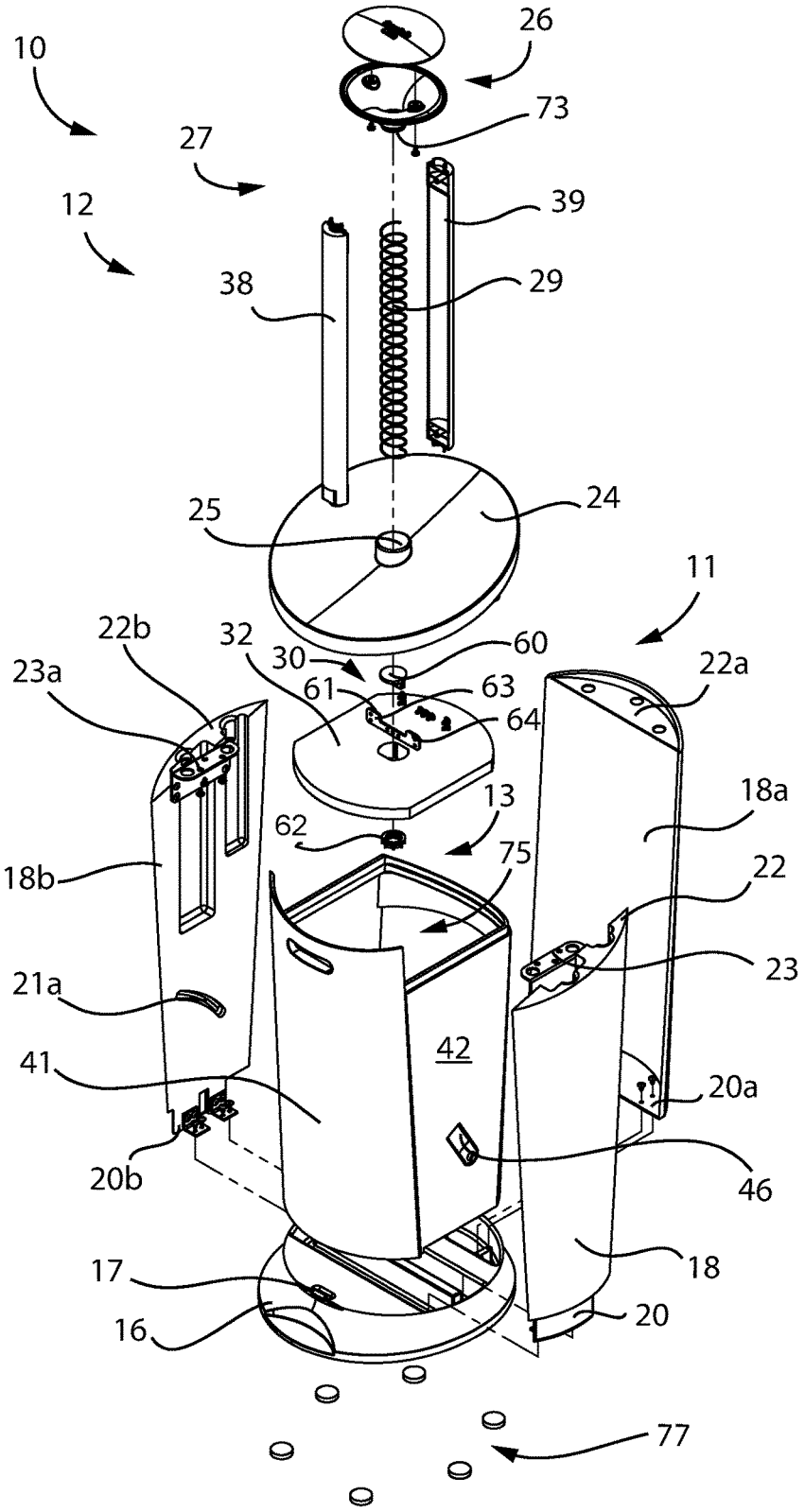
FIG. 2 is an exploded view of the compressible trash receptacle shown in FIG. 1.
Figure 3:
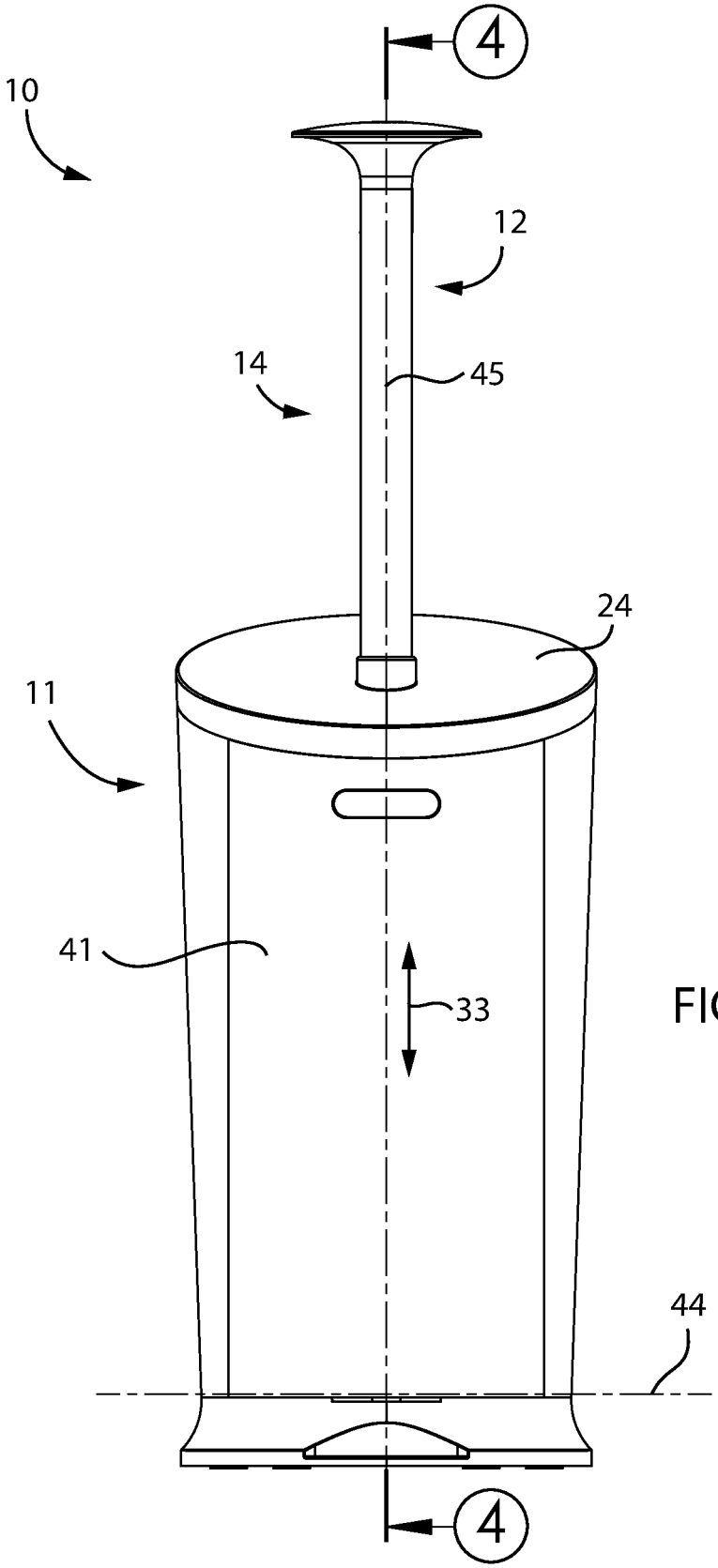
FIG. 3 is a front elevational view of the compressible trash receptacle shown in FIG. 1.
Figure 4:
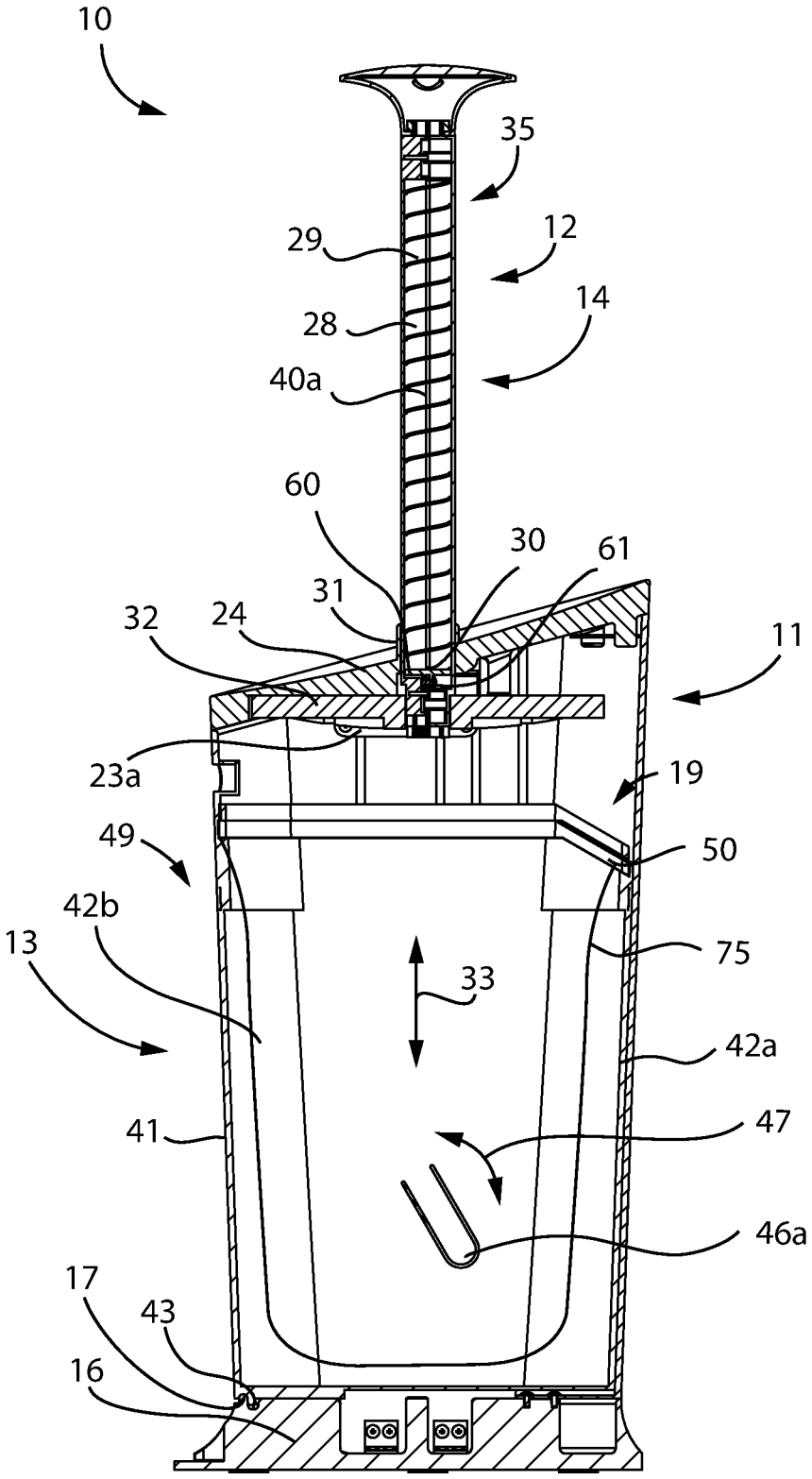
FIG. 4 is a cross-sectional view taken along line 4-4 in FIG. 3, showing the structural interrelationship between the frame, trash-receiving section, and plunger section at a raised position (equilibrium position)
Figure 4A:
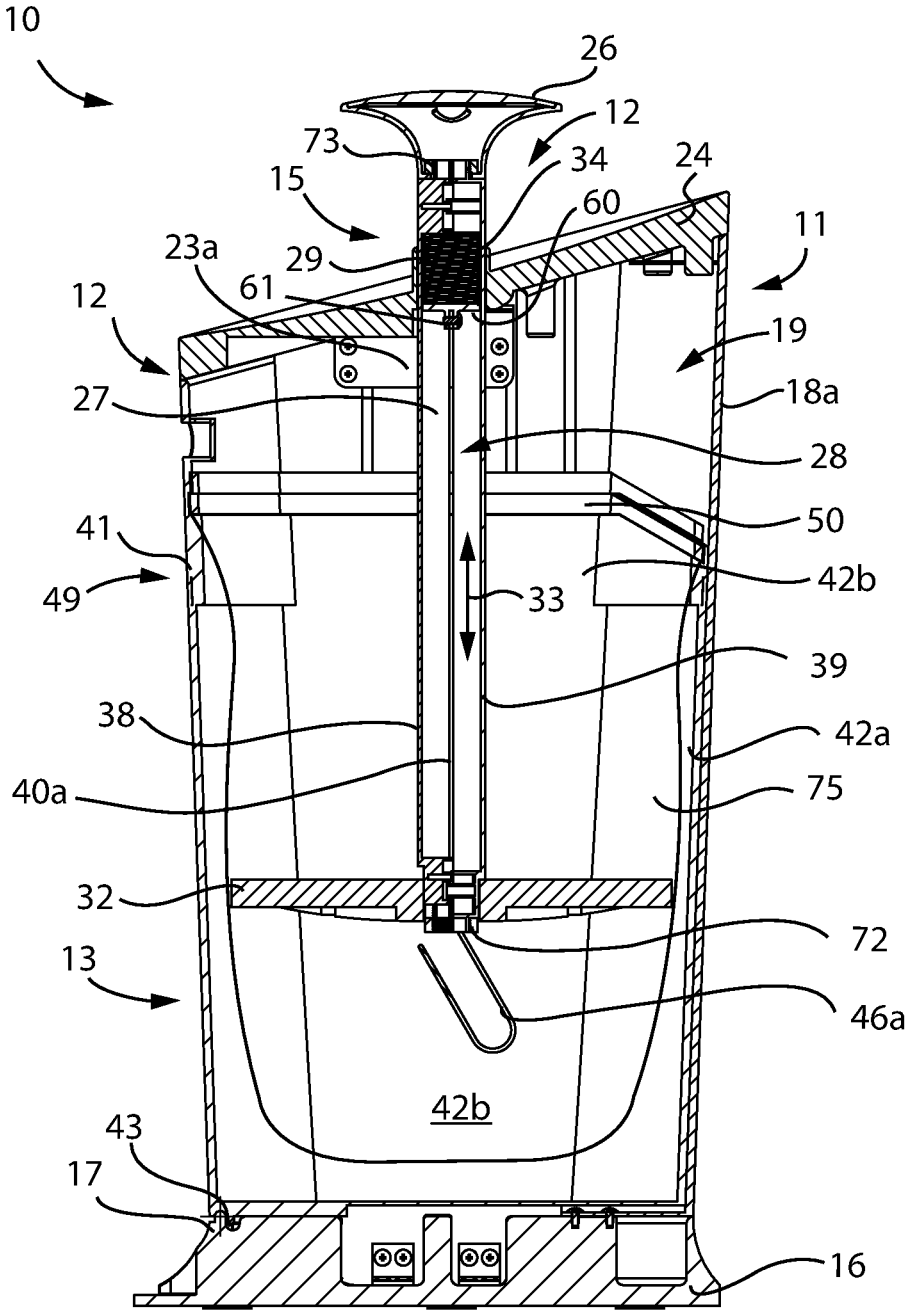
Figure 5:
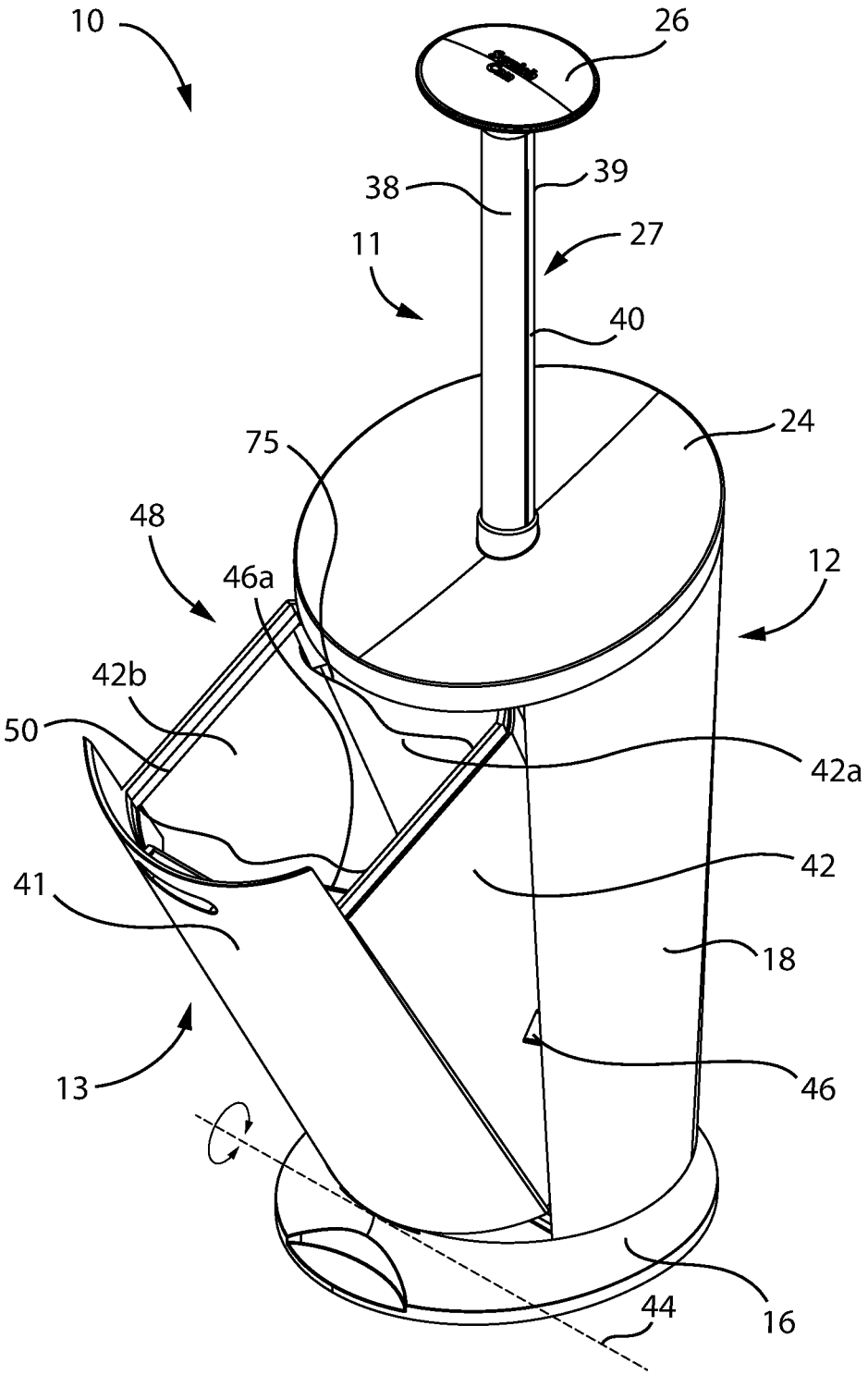
Figure 5A:
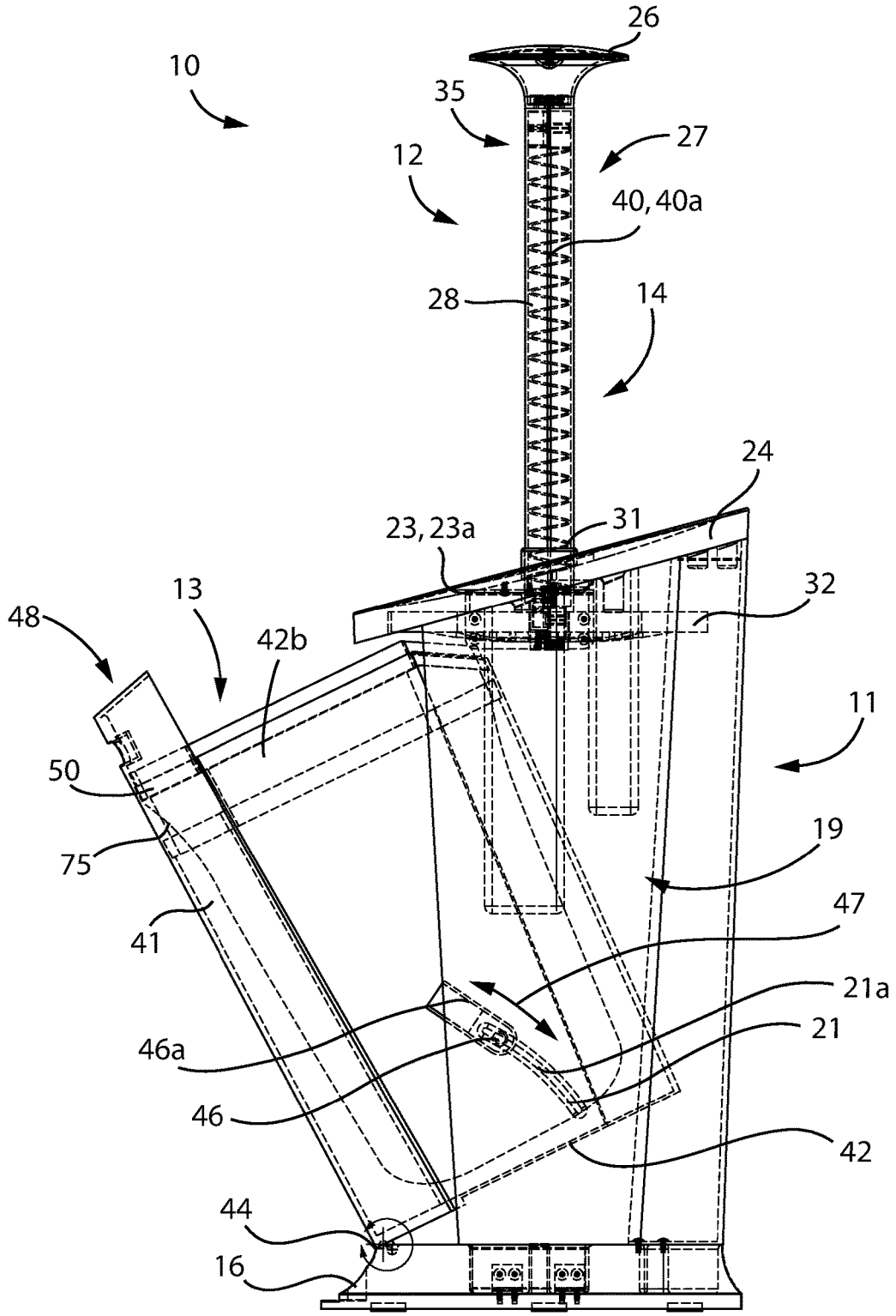
Figure 5B:
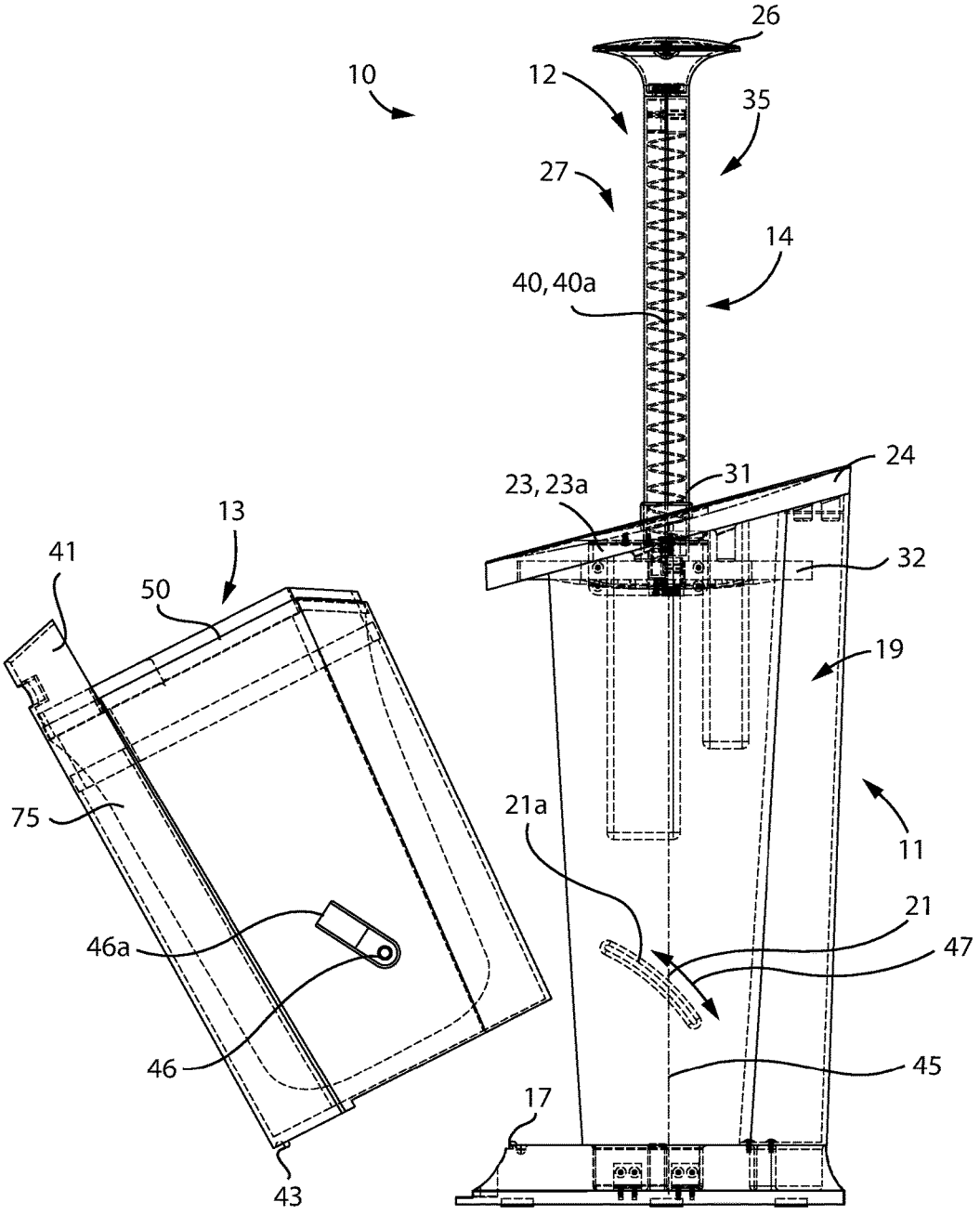
Figure 6:
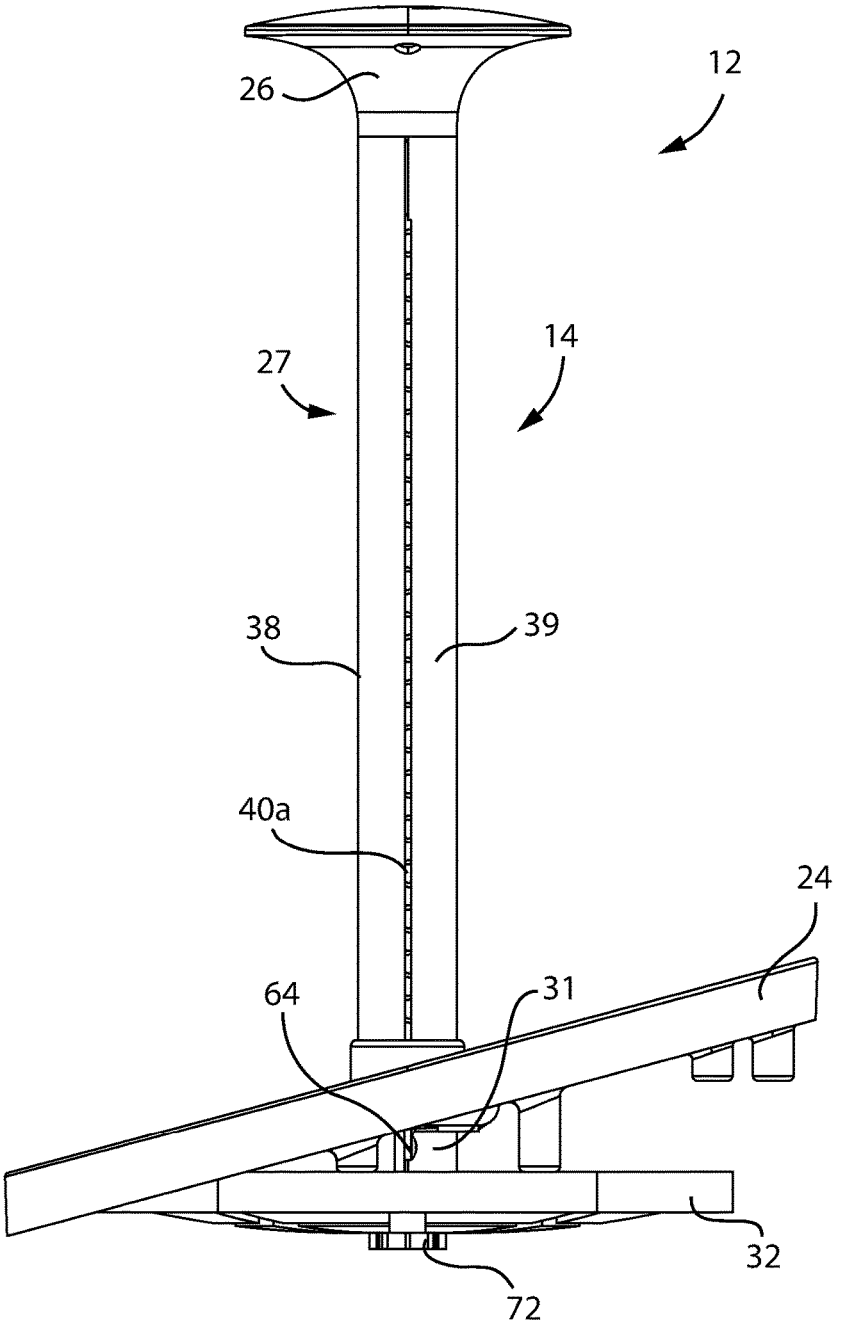
Figure 7:
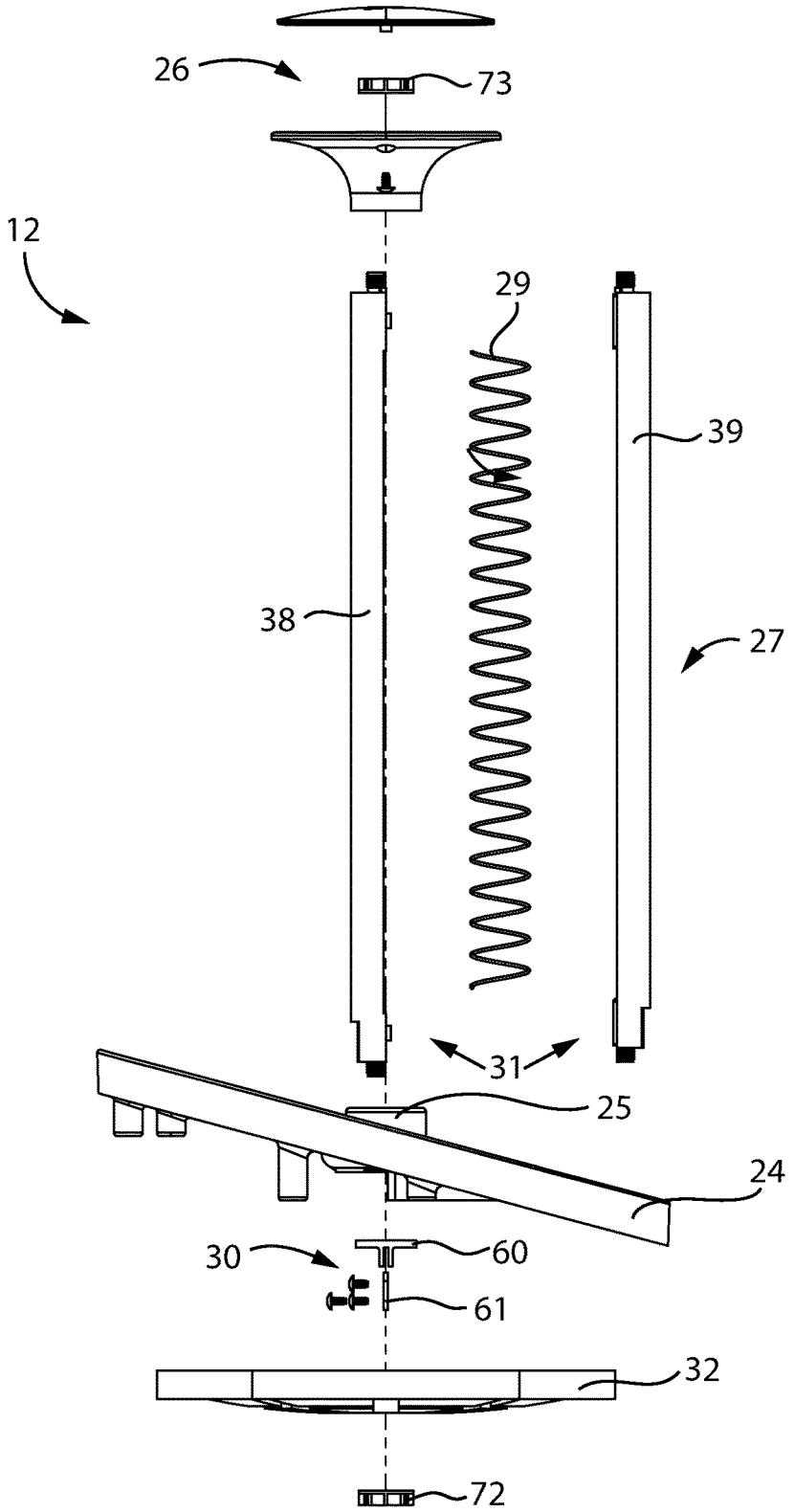

FIG. 4*a* is a cross-sectional view showing the structural interrelationship between the frame, trash-receiving section, and plunger section at a lowered position (tensioned position);

FIG. 5 is a perspective view of the compressible trash receptacle, showing the trash-receiving section articulated to an open position;

FIG. 5*a* is a transparent side elevational view of FIG. 5, showing the structural interrelationship between the resilient fingers and arcuate grooves, as well as the first hinge portion and second hinge portion, respectively;

FIG. 5*b* is a transparent side elevational view showing the trash-receiving section detached (removed) from the frame;

FIG. 6 is an enlarged side elevational view of the plunger section and lid, when the plunger section is disposed at the raised position (equilibrium position); and FIG. 7 is an exploded view of the plunger section and lid illustrated in FIG. 6.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "substantially" means largely if not wholly that which is specified but so close that the difference is insignificant.

If used herein, "about" means approximately or nearly and in the context of a numerical value or range set forth means ±15% of the numerical.

As used herein, the term "arcuate" means the element, when viewed from at least one angle, has a generally crescent shape, with one edge having a concave shape and the opposite edge having a convex shape. The angulation of the curve, i.e. curvature, may vary, for example having a customized curvature.

As used herein, the term "interstitial space" means a hollow space, i.e. not occupied by a solid, which is bound by one or more solids in two dimensions. For example, the interstitial space may have a square cross-section, which is bound in two dimensions by two or more walls. Alternatively, the interstitial space may have an oval or circular cross-section, which is bound in two dimensions by a tubular structure.

Although the cross-sectional hatching patterns identify metal, it is noted that one or more components of the present disclosure made be formed from a variety of materials including plastic, aluminum, etc. without departing from the true spirit and scope of the present disclosure. A variety of fasteners such as screws, nuts, etc. are illustrated for connecting various components of the present disclosure. It is noted that suitable adhesives may also be employed.

The non-limiting exemplary embodiment(s) is/are referred to generally in FIGS. 1-7 and is/are intended to provide a compressible trash receptacle 10 for compacting trash stored therein. The compressible trash receptacle 10 may be portable and used in both personal and commercial environments. The compressible trash receptacle 10 includes a frame 11, a plunger section 12 operably coupled to the frame 11 wherein the plunger section 12 is disposed partially exterior of the frame 11, and a trash-receiving section 13 detachably connected to the frame 11 and in communication with the plunger section 12. In this manner, when no external force acts on the plunger section 12, the plunger section 12 rests at an equilibrium position 14 disposed partially exterior of the trash-receiving section 13. Advantageously, when an external force acts on the plunger section 12, the plunger section 12 moves to a tensioned position 15 disposed partially interior of the trash-receiving section 13.

In a non-limiting exemplary embodiment, the frame 11 includes a base 16 having a first hinge portion 17, and a body 18, 18*a*, 18*b* extending upwardly from the base 16 and configured to form an interstitial space 19 thereabove. Such a body 18 includes a bottom edge 20, 20*a*, 20*b* attached to the base 16, a plurality of arcuate grooves 21, 21*a* located above the bottom edge 20, 20*a*, 20*b*, a top edge 22, 22*a*, 22*b*, and a plurality of brackets 23, 23*a* affixed to the top edge 22, 22*b* and located above the arcuate grooves 21, 21*a*, respectively. The frame 11 further includes a lid 24 having a central aperture 25 formed therein, wherein the lid 24 is positioned on the top edge 22, 22*a*, 22*b* and secured to the brackets 23, 23*a*.

In a non-limiting exemplary embodiment, the plunger section 12 includes a handle 26, a shaft 27 attached to the handle 26 and having an axial bore 28 extending along a longitudinal length thereof, a spring member 29 dynamically located within the shaft 27, a stop member 30 statically nested at a distal end 31 of the shaft 27 and engaged with the spring member 29, and a plate 32 secured to the distal end 31 of the shaft 27 and located subjacent to the lid 24. Fasteners 72, 73 connect the plate 32 to shaft 27 and handle 26 to shaft 27.

Notably, the stop member 30 includes a disc-shaped upper portion 60 statically affixed to a planar-shaped lower portion 61. Such a lower portion 61 has a medial section 62 seated inside the shaft 27, and outer flanges 63, 64 protruding radially outward from the diametrically opposed slots 40, 40*a* of the shaft 27. In particular, the lower portion 61 is anchored to lid 24 and passes through the shaft 27. The upper portion 60 is affixed on top of lower portion 61 and remains seated within the shaft 27. Advantageously, the shaft 27 and the plate 32 synchronously reciprocate along a linear travel path 33 aligned with the central aperture 25. Notably, the spring member 29 is compressed to a tensioned state 34 when the shaft 27 and the plate 32 downwardly ingress the trash-receiving section 13. Such a spring member 29 is extended to a non-tensioned state 35 when the shaft 27 and the plate 32 upwardly egress the trash-receiving section 13. This is achieved by maintaining the stop member 30 at a fixed position relative to linear reciprocation of shaft 27 so that slots 40, 40*a* permit shaft 27 to slide up and down lower portion 61 affixed to lid 24.

In a non-limiting exemplary embodiment, the plate 32 is prohibited from egressing the frame 11 while the plunger section 12 is at both the equilibrium position 14 and the tensioned position 15. Thus, plate 32 remains inside the interstitial space 19 at all times during normal use.

In a non-limiting exemplary embodiment, the spring member 29 is prevented from being displaced below the stop member 30 such that the spring member 29 is compressed when the shaft 27 is slidably displaced below the stop member 30. Again, stop member 30 is anchored to lid 24 and remains stationary as shaft 27 reciprocates along linear travel path 33.

In a non-limiting exemplary embodiment, the linear displacement of the shaft 27 to the equilibrium position 14 causes decompression of the spring member 29 to the non-tensioned state 35 so that the plate 32 is elevated above the trash-receiving section 13. Plate 32 abuts a bottom surface of lid 24 when the spring member 29 is at the non-tensioned state 35, so that trash-receiving section 13 is freely pivoted between an open position 48 and a closed position 49.

In a non-limiting exemplary embodiment, the shaft 27 is bifurcated into a first half 38 and a second half 39. Such a shaft 27 has slots 40, 40*a* formed between the first half 38 and the second half 39 such that the stationary planar-shaped lower portion 61 of stop member 30 is slidably guided (but remains stationary) along the slots 40, 40*a* while the stationary disc-shaped upper portion 60 of stop member 30 remains statically seated in the shaft 30, when the plunger section 12 is lowered and raised between the tensioned position 15 and the equilibrium position 14, respectively.

In a non-limiting exemplary embodiment, the trash-receiving section 13 is located within the interstitial space 19 and includes an access panel 41 and a plurality of sidewalls

42, 42*a*, 42*b* coupled thereto, and a second hinge portion 43 formed at the access panel 41. Such a second hinge portion 43 is rotatably and detachably engaged with the first hinge portion 17 such that the access panel 41 is pivotal about a fulcrum axis 44 oriented orthogonal to a centrally registered longitudinal axis 45 of the frame 11. The trash-receiving section 13 further includes a plurality of resilient fingers 46, 46*a* protruding outwardly from the sidewalls 42, 42*b*, respectively. Such resilient fingers 46 are slidably engaged with the arcuate grooves 21, 21*a* respectively, such that the access panel 41 is guided along an arcuate path 47 when biased between open position 48 and closed position 49.

In a non-limiting exemplary embodiment, a trash bag 75 may be nested within the interstitial space 19 by positioning a rim 50 about a top opening of the trash bag 75 and the trash-receiving section 13. The rim 50 may snap fit into place, thereby maintaining the trash bag 75 at an open position 48 while situated within the trash-receiving section 13 inside the interstitial space 19 of the frame 11. During disposal, the rim 50 is detached from the access panel 41 and sidewalls 42, 42*a*, 42*b*, thereby allowing the user to remove the trash bag 75. Optionally, spacers 77 may be affixed to the bottom of base 16 for frictional support.

In a non-limiting exemplary embodiment, the resilient fingers 46, 46*a* are disengaged from the arcuate grooves 21, 21*a*, respectively, such that the first hinge portion 17 is detached from the second hinge portion 43. Such resilient fingers 46, 46*a* are depressed inwardly to release from arcuate grooves 21, 21*a*.

The present disclosure further includes a method of utilizing a compressible trash receptacle 10 for selectively compacting trash stored therein. Such a method includes the steps of: providing a frame 11; providing and operably coupling a plunger section 12 to the frame 11 so that the plunger section 12 is disposed partially exterior of the frame 11; providing and detachably connecting a trash-receiving section 13 to the frame 11; and communicating the trash-receiving section 13 with the plunger section 12.

The method further includes the steps of: exerting no external force on the plunger section 12 such that the plunger section 12 rests at an equilibrium position 14 disposed partially exterior of the trash-receiving section 13; and exerting an external force on the plunger section 12 such that the plunger section 12 moves to a tensioned position 15 disposed partially interior of the trash-receiving section 13.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A compressible trash receptacle for selectively compacting trash stored therein, said compressible trash receptacle comprising:

a frame;

a plunger section operably coupled to said frame; and a trash-receiving section detachably connected to said frame and in communication with said plunger section;

wherein, when no external force acts on said plunger section, said plunger section rests at an equilibrium position disposed partially exterior of said trash-receiving section;

wherein, when an external force acts on said plunger section, said plunger section moves to a tensioned position disposed partially interior of said trash-receiving section;

wherein said frame comprises a base having a first hinge portion;

a body extending upwardly from said base and configured to form an interstitial space thereabove, said body including a bottom edge attached to said base, a plurality of arcuate grooves located above said bottom edge, a top edge, and a plurality of brackets affixed to said top edge and located above said arcuate grooves respectively; and a lid positioned on said top edge and secured to said brackets, said lid having a central aperture formed therein.

2. The compressible trash receptacle of claim 1, wherein said plunger section comprises:

a handle;

a shaft attached to said handle and having an axial bore extending along a longitudinal length thereof;

a spring member dynamically located within said shaft;

a stop member statically nested at a distal end of said shaft and engaged with said spring member; and a plate secured to said distal end of said shaft and located subjacent to said lid;

wherein said shaft and said plate synchronously reciprocate along a linear travel path aligned with said central aperture;

wherein said spring member is compressed to a tensioned state when said shaft and said plate downwardly ingress said trash-receiving section;

wherein said spring member is extended to a non-tensioned state when said shaft and said plate upwardly egress said trash-receiving section.

3. The compressible trash receptacle of claim 2, wherein said plate is prohibited from egressing said frame while said plunger section is at both said equilibrium position and said tensioned position.

4. The compressible trash receptacle of claim 2, wherein said spring member is prevented from being displaced below said stop member such that said spring member is compressed when said shaft is slidably displaced below said stop member.

5. The compressible trash receptacle of claim 2, wherein linear displacement of said shaft to said equilibrium position causes decompression of said spring member to said non-tensioned state so that said plate is elevated above said trash-receiving section.

6. The compressible trash receptacle of claim 2, wherein said shaft is bifurcated into a first half and a second half, said shaft having a slot formed between said first half and said second half such that said stop member is slidably guided along said slot when said plunger section is lowered and raised between said tensioned position and said equilibrium position, respectively.

7. The compressible trash receptacle of claim 1, wherein said trash-receiving section is located within said interstitial space and comprises:

an access panel and a plurality of sidewalls coupled thereto;

a second hinge portion formed at said access panel, said second hinge portion being rotatably and detachably engaged with said first hinge portion such that said access panel is pivotal about a fulcrum axis oriented orthogonal to a centrally registered longitudinal axis of said frame; and a plurality of resilient fingers protruding outwardly from said sidewalls, respectively, said resilient fingers being slidably engaged with said arcuate grooves, respectively, such that said access panel is guided along an arcuate path when biased between an open position and a closed position.

8. The compressible trash receptacle of claim 7, wherein said resilient fingers are disengaged from said arcuate grooves such that said first hinge portion is detached from said second hinge portion.

9. A compressible trash receptacle for selectively compacting trash stored therein, said compressible trash receptacle comprising:

a frame;

a plunger section operably coupled to said frame; and a trash-receiving section detachably connected to said frame and in communication with said plunger section;

wherein, when no external force acts on said plunger section, said plunger section rests at an equilibrium position disposed partially exterior of said trash-receiving section;

wherein, when an external force acts on said plunger section, said plunger section moves to a tensioned position disposed partially interior of said trash-receiving section;

wherein said plunger section is disposed partially exterior of said frame;

wherein said frame comprises a base having a first hinge portion;

a body extending upwardly from said base and configured to form an interstitial space thereabove, said body including a bottom edge attached to said base, a plurality of arcuate grooves located above said bottom edge, a top edge, and a plurality of brackets affixed to said top edge and located above said arcuate grooves respectively; and a lid positioned on said top edge and secured to said brackets, said lid having a central aperture formed therein.

10. The compressible trash receptacle of claim 9, wherein said plunger section comprises:

a handle;

a shaft attached to said handle and having an axial bore extending along a longitudinal length thereof;

a spring member dynamically located within said shaft;

a stop member statically nested at a distal end of said shaft and engaged with said spring member; and a plate secured to said distal end of said shaft and located subjacent to said lid;

wherein said shaft and said plate synchronously reciprocate along a linear travel path aligned with said central aperture;

wherein said spring member is compressed to a tensioned state when said shaft and said plate downwardly ingress said trash-receiving section;

wherein said spring member is extended to a non-tensioned state when said shaft and said plate upwardly egress said trash-receiving section.

11. The compressible trash receptacle of claim 10, wherein said plate is prohibited from egressing said frame while said plunger section is at both said equilibrium position and said tensioned position.

12. The compressible trash receptacle of claim 10, wherein said spring member is prevented from being displaced below said stop member such that said spring member is compressed when said shaft is slidably displaced below said stop member.

13. The compressible trash receptacle of claim 10, wherein linear displacement of said shaft to said equilibrium position causes decompression of said spring member to said non-tensioned state so that said plate is elevated above said trash-receiving section.

14. The compressible trash receptacle of claim 10, wherein said shaft is bifurcated into a first half and a second half, said shaft having a slot formed between said first half and said second half such that said stop member is slidably guided along said slot when said plunger section is lowered and raised between said tensioned position and said equilibrium position, respectively.

15. The compressible trash receptacle of claim 9, wherein said trash-receiving section is located within said interstitial space and comprises:

an access panel and a plurality of sidewalls coupled thereto;

a second hinge portion formed at said access panel, said second hinge portion being rotatably and detachably engaged with said first hinge portion such that said access panel is pivotal about a fulcrum axis oriented orthogonal to a centrally registered longitudinal axis of said frame; and a plurality of resilient fingers protruding outwardly from said sidewalls, respectively, said resilient fingers being slidably engaged with said arcuate grooves, respectively, such that said access panel is guided along an arcuate path when biased between an open position and a closed position.

16. The compressible trash receptacle of claim 15, wherein said resilient fingers are disengaged from said arcuate grooves such that said first hinge portion is detached from said second hinge portion.

* * * * *